US005836376A

United States Patent [19]

Matsui et al.

[11] Patent Number: 5,836,376

[45] Date of Patent: Nov. 17, 1998

[54] METHOD AND APPARATUS FOR GIVING VIBRATION TO MOLTEN METAL IN TWIN ROLL CONTINUOUS CASTING MACHINE

[75] Inventors: Kunio Matsui, Yokohama; Atsushi Hirata, Hiratsuka; Akihiko Kimatsuka, Chigasaki, all of Japan

[73] Assignees: Ishikawajima-Harima Heavy Industries Co. Ltd., Tokyo, Japan; BHP Steel (JLA) PTY. Ltd., Mebourne, Australia

[21] Appl. No.: 679,569

[22] Filed: Jul. 15, 1996

[30] Foreign Application Priority Data

Jul. 19, 1995 [AU] Australia ..... PN4260

[51] Int. Cl.[6] ..... B22D 27/02; B22D 11/06

[52] U.S. Cl. ..... 164/466; 164/502; 164/480; 164/428; 164/504

[58] Field of Search ..... 164/466, 502, 164/480, 428, 416, 478, 467, 503, 504

[56] References Cited

U.S. PATENT DOCUMENTS

Re. 32,529 10/1987 Vives ..... 164/467
5,584,338 12/1996 Freeman et al. ..... 164/416

FOREIGN PATENT DOCUMENTS 3517733 11/1986 Germany ..... 164/467

*Primary Examiner*—Joseph J. Hail, III
*Assistant Examiner*—I.-H. Lin
*Attorney, Agent, or Firm*—Nikaido Marmelstein Murray & Oram, LLP

[57] ABSTRACT

To give vibration to molten metal in a melt pool to enhance solidification efficiency of the molten metal.

Substantially directly above meniscus 14 between molten metal 5 in a melt pool 4 and each of rolls, an AC electromagnet 15 is arranged over the entire length of said meniscus 14 so that magnetic flux runs substantially perpendicular to a surface of the molten metal. Above the AC electromagnet 15, a DC electromagnet 16 is arranged over the entire length of the AC electromagnet 15 so that magnetic flux runs substantially perpendicular to the surface of the molten metal. Under application of DC magnetic field by means of the DC electromagnet 16, an AC magnetic field is applied near the meniscus 14 between the molten metal 5 in the melt pool 4 and each of the rolls 1 and 2. As a result, induction current is generated in the molten metal 5 and high frequency vibration is applied to the molten metal 5 by Lorentz's force due to interaction between the induction current and the DC magnetic field.

13 Claims, 4 Drawing Sheets

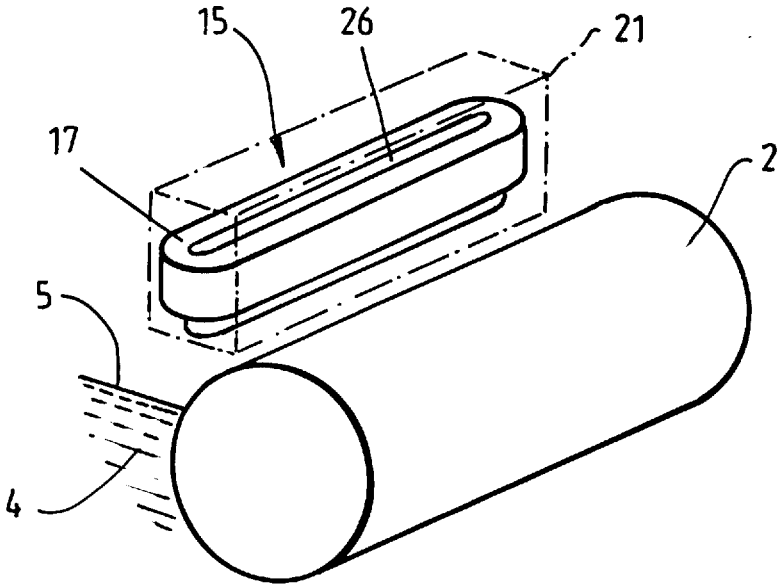
FIG. 2.
FIG. 3.
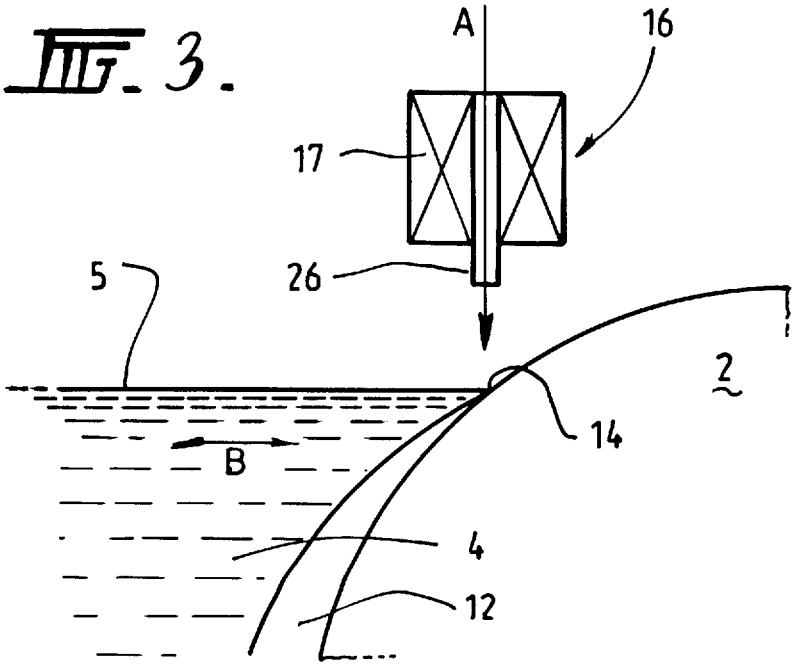

METHOD AND APPARATUS FOR GIVING VIBRATION TO MOLTEN METAL IN TWIN ROLL CONTINUOUS CASTING MACHINE

BACKGROUND OF THE INVENTION

The present invention relates to a method and apparatus for giving vibration to molten metal in twin roll continuous casting machine.

In a twin roll continuous casting machine, between upper surfaces of opposite ends of a pair of rolls arranged horizontally and in parallel with each other, seal plates called side dams are abutted to confine a melt pool above a nip between the rolls. Molten metal is supplied to the pool and is solidified on the roll surfaces. The rolls are rotated under this condition so that solidified shells formed on the roll surfaces are pulled down together to directly cast a strip.

FIG. 7 represents a conventional twin roll continuous casting machine. As shown in the figure, a pair of rolls 1 and 2, which are internally coolable, are arranged horizontally and in parallel with each other with a predetermined nip. Between upper surfaces of opposite ends of the rolls 1 and 2, seal plates called side dams 3 are abutted to confine a melt pool 4 above the nip between the rolls 1 and 2.

In order to supply the molten metal 5 to the pool 4, a tundish 6 is arranged above the pool 4 and has a pouring nozzle 7 protruded from the tundish 6 to the pool 4.

Further, an inert gas chamber 8 is provided under the tundish 6 to surround the pool 4. The chamber 8 is partitioned into upper and lower portions by a straightening plate 9 such as punched plate and has inert gas inlets 11 arranged in the chamber 8 at positions above the plate 9 so as to supply inert gas 10 such as nitrogen or argon gas to the chamber for prevention of the molten metal 5 in the pool 4 from being oxidised.

Reference numeral 12 denotes solidified shells on the surfaces of rolls 1 and 2; and 13, a produced strip.

Thus, the molten metal 5 in the tundish 6 is supplied to the melt pool 4 via the nozzle 7 and is solidified on the surfaces of the rolls 1 and 2. Under this condition, the rolls 1 and 2 are rotated in the direction of the arrows shown in the figure so that the solidified shells 12 formed on the surfaces of the rolls 1 and 2 are pulled down together to continuously cast the strip 13.

Disadvantageously in the conventional twin roll continuous casting machine as described above, the produced strip 13 is so thin in thickness that its production yield per machine is lower than that of an ordinary slab continuous casting machine. For the purpose of increasing the production yield, measures are being taken into consideration such as designing a twin roll continuous casting machine itself in larger size or enhancing the productivity through drastic enhancement of the solidification efficiency and increase of rotating velocity of rolls. There is, however, limitation in terms of facilities and equipment to make a large-sized twin roll continuous casting machine and therefore there are strong demands on technical development of enhancing the solidification efficiency for enhanced productivity.

As means or measure for enhancing the solidification efficiency of molten metal, it has been reported in recent years that high frequency vibration of about 5 to 10 kHz applied to molten metal remarkably enhances the solidification efficiency of the molten metal. The inventors have studied application of such solidification behaviour of molten metal to a twin roll continuous casting machine.

However, in attempt of mechanically vibrating the rolls 1 and 2 with respect to the molten metal 5 in the melt pool 4, mechanically vibrating the rotating rolls 1 and 2 itself is difficult to carry out. It is, therefore, practically impossible to mechanically vibrate with very small amplitude in the order of microns to produce high frequency vibration of about 5 to 10 kHz.

The present invention was made in view of the above and has its object to provide a method and an apparatus for giving vibration to molten metal in a twin roll continuous casting machine in which high frequency vibration can be applied to molten metal in a melt pool to enhance solidification efficiency of the molten metal.

SUMMARY OF THE INVENTION

Accordingly, the present invention provides a method for giving vibration to molten metal in a twin roll continuous casting machine, characterised in that, under application of DC magnetic field, AC magnetic field is applied near the meniscus defined by the molten metal in a melt pool and each of the rolls, thereby generating induction current in the molten metal, and high frequency vibration is given to said molten metal by Lorentz's force due to interaction of said induction current with said DC magnetic field.

The present invention further provides apparatus for giving vibration to molten metal in a continuous casting machine, characterised in that an AC electromagnet is arranged substantially directly above the meniscus defined by the molten metal in a melt pool and a casting surface over the length of the meniscus such that magnetic fluxes run substantially perpendicular to a surface of said molten metal and a DC electromagnet is arranged over the length of said AC electromagnet such that magnetic fluxes run substantially perpendicular to the surface of the molten metal.

Preferably, the AC and DC electromagnets are held by water-cooled jackets, respectively.

Therefore, in the method for giving vibration to molten metal in a twin roll continuous casting machine according to the present invention, electromagnetic forces can be utilised to apply high frequency vibration on non-contact basis to the molten metal in a melt pool. As a result, remarkably improved is solidification efficiency of the molten metal, in particular, initial solidification efficiency near the meniscus.

In the apparatus for giving vibration to molten metal in a continuous casting machine according to the present invention, the DC electromagnet is energised to apply the DC magnetic field to the molten metal in the molten metal pool and the AC electromagnet is energised to apply the AC magnetic field near the meniscus of said molten metal and the casting surface or surfaces. As a result, induction current (eddy current) running axially of the rolls, which is generated in the molten metal by said AC magnetic field, interacts with said DC magnetic field to generate Lorentz's force in horizontal direction perpendicular to the direction of magnetic fluxes of the DC magnetic field and perpendicular to the flowing direction of the induction current according to Fleming's rule, and the molten metal is vibrated with high frequency in accordance with AC frequency by Lorentz's force.

Further, when the AC and DC electromagnets are held by watercooled jackets, respectively, the AC and DC electromagnets can be protected from heat of the molten metal.

The AC electromagnet may comprise an elongated comb-like core having an elongated plate-like body and a plurality of equispaced projections extending from a longitudinal edge thereof, and an AC coil wound around the outer periphery of the core.

In an alternative embodiment, the AC electromagnet may comprise a plurality of rod-like cores, each core having an AC coil wound cylindrically therearound.

The present invention further provides a method of continuously casting metal strip comprising:

introducing molten metal into a nip between a pair of parallel casting rolls via metal delivery means disposed above the nip to create a casting pool of molten metal supported on casting surfaces of the rolls immediately above the nip;

counter-rotating the casting rolls to deliver a solidified metal strip downwardly from the nip;

applying a DC magnetic field and an AC magnetic field to the molten metal of the casting pool to induce high frequency relative vibratory movement between the molten metal of the casting pool and the casting surfaces of the rolls.

Preferably the AC magnetic field is applied near a meniscus defined by the molten metal of the casting pool and the casting surface of the rolls.

Preferably further the AC magnetic field is applied by means of a pair of AC electromagnets, each AC electromagnet being disposed above the surface of the casting pool near a respective roll and extending substantially parallel thereto.

The present invention further provides apparatus for continuously casting metal strip comprising a pair of parallel casting rolls forming a nip between them, metal delivery means for delivery of molten metal into the nip between the casting rolls to form a casting pool of molten metal supported on casting roll surfaces immediately above the nip, roll drive to drive the casting rolls in counter-rotational direction to produce a solidified strip of metal delivered downwardly from the nip, and vibration means operable to induce high frequency relative vibratory movement between the molten metal of the casting pool and the casting surfaces of the rolls, wherein the vibration means comprises means to provide an AC electromagnet field and means to provide a DC electromagnet field, said AC electromagnet means being arranged substantially directly above the molten metal of the casting pool and extending along the length of the casting pool such that magnetic fluxes run substantially perpendicular to the surface of the molten metal, and said DC electromagnet means is arranged over the length of said AC electromagnet means such that magnetic fluxes run substantially perpendicular to the surface of the molten metal.

Preferably the AC electromagnet means is arranged substantially above the meniscus defined by the molten metal of the casting pool and the casting surfaces of the rolls over the length of the meniscus.

The AC electromagnet means may comprise an elongated comb-like core having an elongated plate-like body and a plurality of equispaced projections extending from a longitudinal edge thereof, and an AC coil wound around the outer periphery of the core.

In an alternative embodiment, the AC electromagnet means may comprise a plurality of rod-like cores, each core having an AC coil wound cylindrically therearound.

Preferably the AC electromagnet means comprises an AC electromagnet provided along each of the rolls.

BRIEF DESCRIPTION OF THE DRAWINGS

Embodiments of the present invention will now be described in conjunction with the drawings.

FIG. 2 A perspective view of the AC electromagnet shown in FIG. 1.

FIG. 3 A enlarged front view for explaining applied direction of Lorentz's force to the molten metal.

DESCRIPTION OF THE PREFERRED EMBODIMENTS

FIGS. 1 to 4 represent an embodiment of the present invention.

Figure 7:
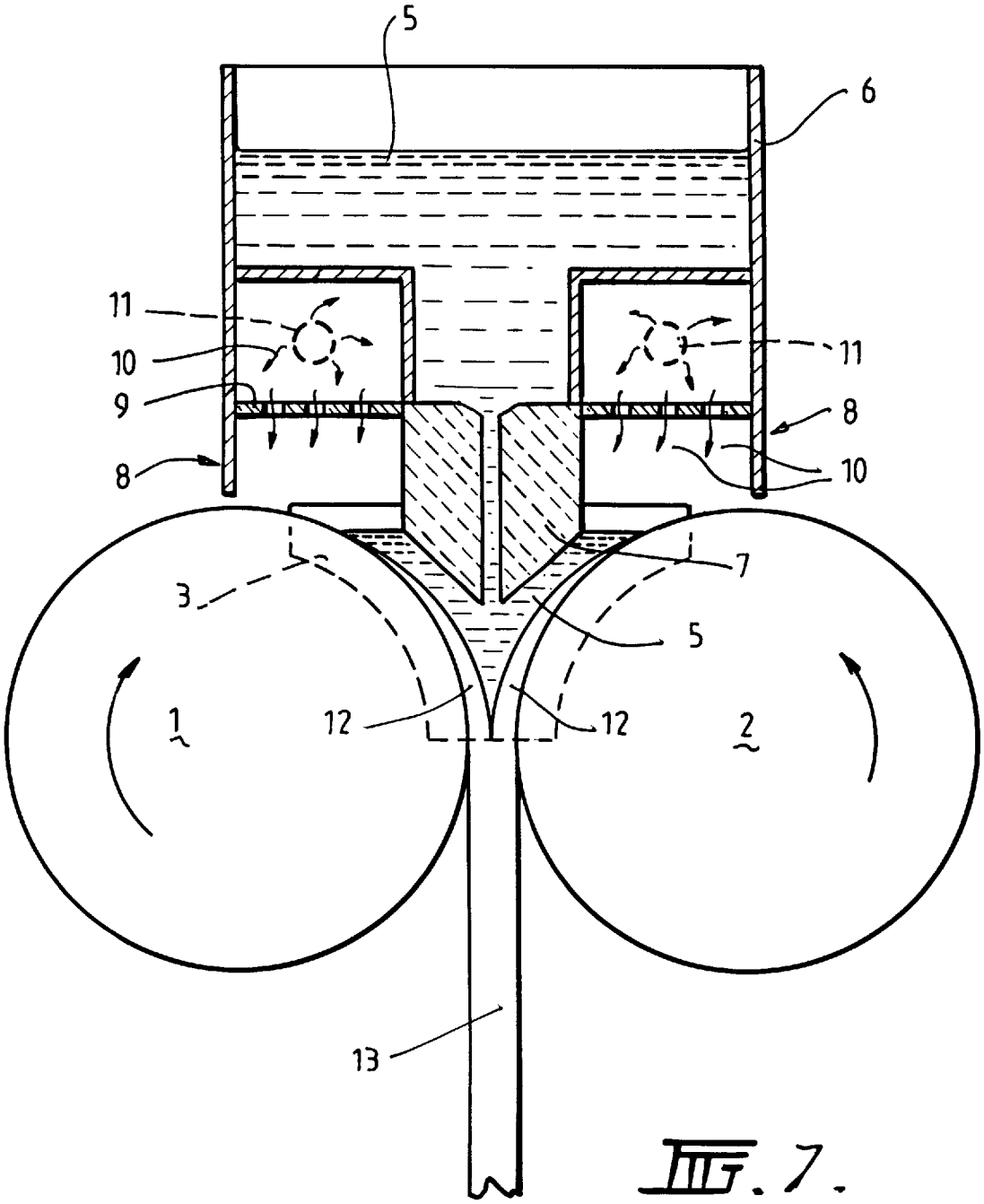
FIG. 7 A front view in section of a conventional apparatus.

The same components as those shown in FIG. 7 are referred to by the same reference numerals.

Substantially directly above meniscus 14 (where surface of a molten metal 5 contacts the surface of each of rolls 1 and 2) defined by the molten metal 5 in a melt pool 4 above the nip between the rolls 1 and 2 and by each of the rolls 1 and 2, an AC electromagnet 15 is arranged over the entire length of the meniscus 14 so that magnetic fluxes run substantially perpendicular to the surface of the molten metal 5. Above the AC electromagnet 15, a DC electromagnet 16 is arranged over the entire length of the AC electromagnet 15 such that magnetic fluxes run substantially perpendicular to the surface of the molten metal 5.

Each AC electromagnet 15 comprises, as shown in FIG. 2, an AC coil which is wound substantially horizontally around an outer periphery of an elongated plate-like core 26. The core 26 extends axially of the roll 1 and 2 (only the roll 2 is shown in FIG. 2) and the AC coil 17 is connected to an AC power source (not shown) outside of an inert gas chamber 18 which surrounds the coil 17.

The DC electromagnet 16 comprises a DC coil 20 which is wound substantially horizontally around upper and outer periphery of a pouring nozzle 19 extending axially of the rolls 1 and 2 and which is connected to a DC power source (not shown) outside the chamber 18.

Further, in this embodiment, the electromagnets 15 and 16 are held by water-cooled jackets 21 and 22, respectively, and are cooled by coolant water supplied to and discharged from each of the jackets 21 and 22 from and to the outside of the chamber 18. The jacket 21 for the AC electromagnet 15 is supported by a support 23 which extends axially of the rolls 1 and 2 and which is fixed at its opposite ends to front and rear walls of the inert gas chamber 18. The jacket 22 for the DC electromagnet 16 is supported by the nozzle 19 and by the bottom of the tundish 6.

Figure 1:
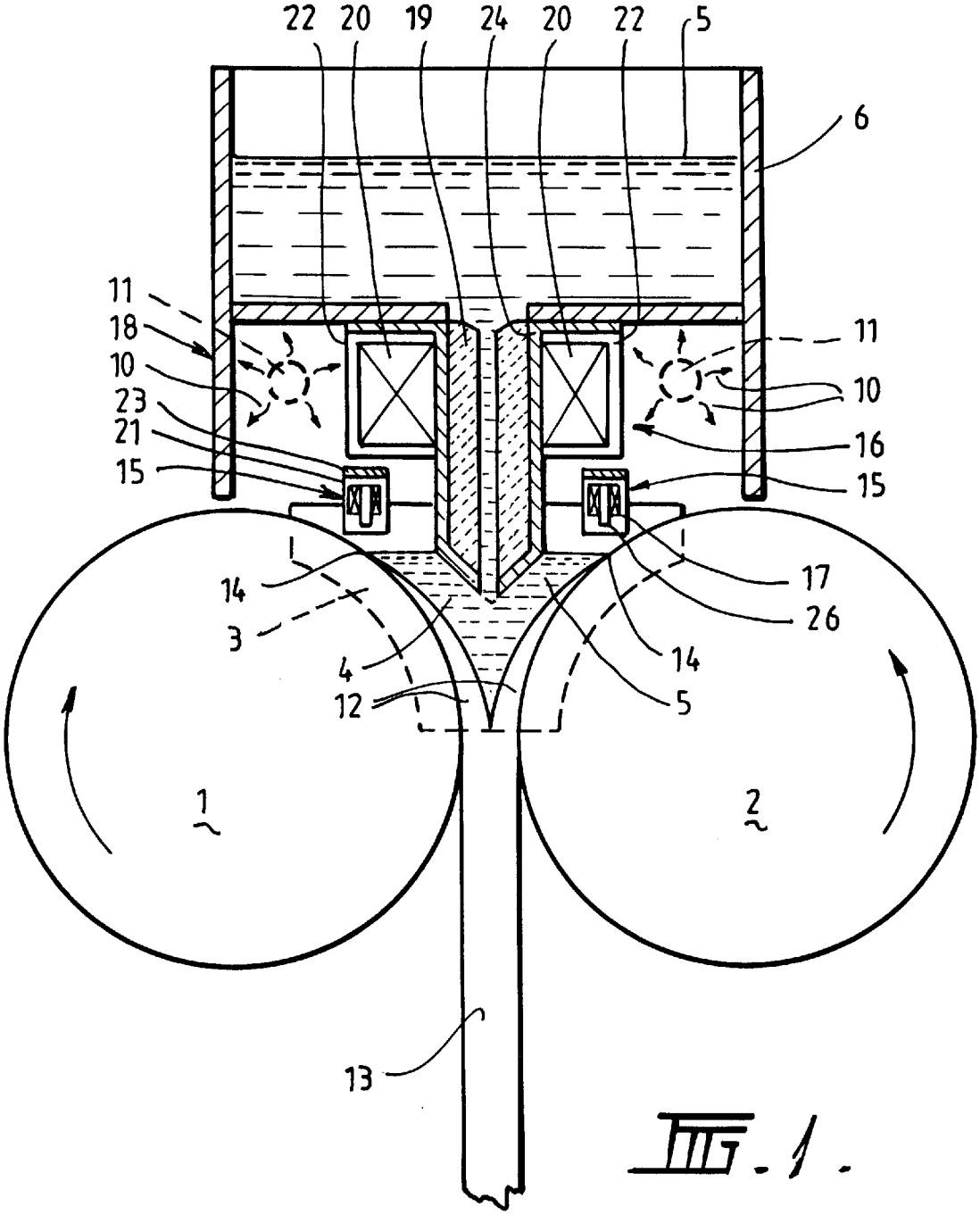
FIG. 1 A front view in section of an embodiment of the present invention.

In FIG. 1, reference numeral 24 represents heat insulating material which is used for thermal insulation between the nozzle 19 and bottom of the tundish 6 and the water-cooled jackets 21 and 22.

Thus, the DC electromagnet 16 is energised to apply DC magnetic field on the molten metal 5 in the melt pool 4 and the AC electromagnet 15 is energised to apply AC magnetic field near the meniscus 14 defined by the molten metal 5 and each of the rolls 1 and 2. Then, induction current (eddy current) flowing axially of the rolls 1 and 2, which is generated in the molten metal 5 by said AC magnetic field, interacts with the DC magnetic field to generate Lorentz's force in horizontal direction (shown by the arrow B in FIG. 3) perpendicular to the direction of magnetic fluxes of the DC magnetic field (shown by the arrow A in FIG. 3) and perpendicular to the flowing direction of the induction current (perpendicular to the paper plane of FIG. 3) according to Fleming's rule. Said Lorentz's force gives vibration to the molten metal 5 with high frequency of about 5 to 10 kHz in accordance with AC frequency.

Figure 4:
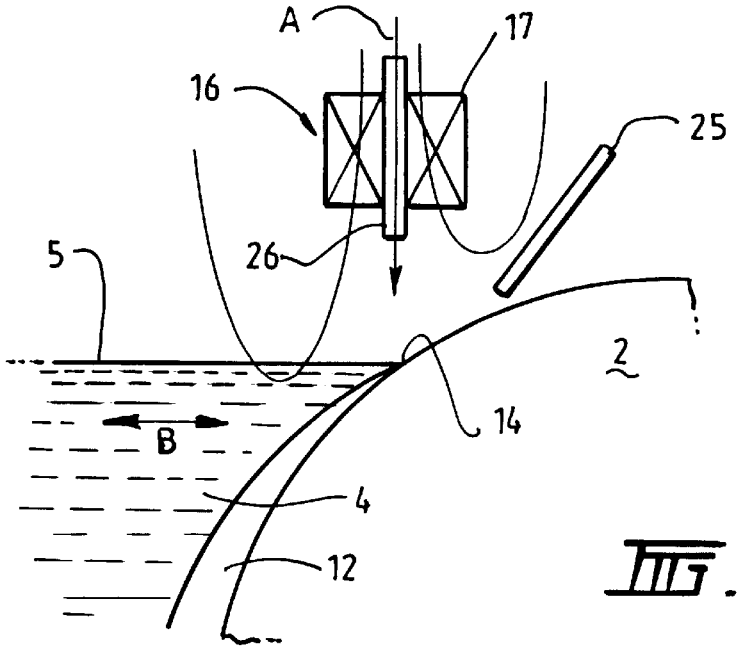
FIG. 4 A view for explaining adjustment of flux distribution in an AC magnetic field by use of a non-magnetic screen.

In this case, a non-magnetic screen 25 may be inserted as shown in FIG. 4 to adjust magnetic flux distribution in the AC magnetic field so as to ensure better applied position and intensity of the Lorentz's force.

Therefore, according to the above embodiment, electromagnetic forces are utilised to give high frequency vibration on non-contact basis to the molten metal 5 in the melt pool 4 to thereby remarkably enhance the solidification efficiency of the molten metal 5, in particular, initial solidification efficiency near the meniscus 14. This enables increase of rotating velocity of the rolls, thereby drastically enhancing the productivity.

Additionally, enhancement of the solidification efficiency of the molten metal 5 can enhance separability of the solidified shells 12 from the surface of the rolls, which contributes to improved surface property of the strip 13.

Further, when the AC and DC electromagnets 15 and 16 are held by the water-cooled jackets 21 and 22 as shown in the present embodiment the electromagnets 15 and 16 can be protected from heat of the molten metal 5, which contributes to drastic enhancement of durability of the electromagnets 15 and 16.

Figure 5:
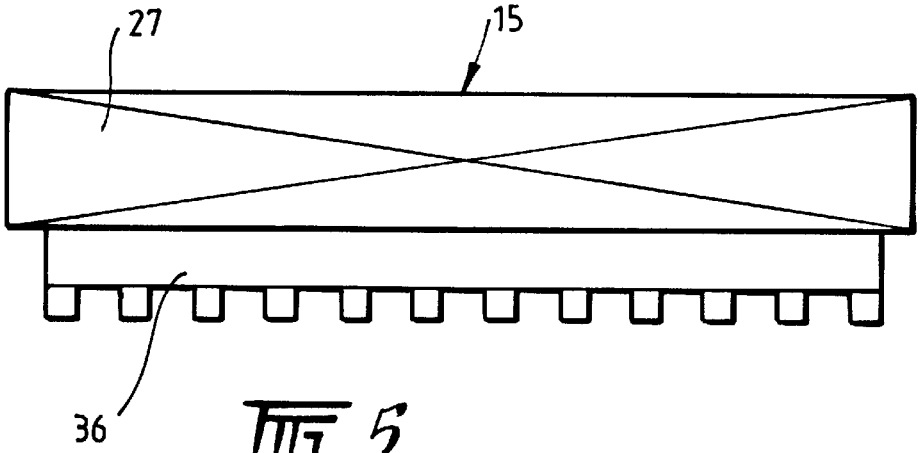
FIG. 5 An enlarged cross-sectional view of another embodiment of the AC electromagnet illustrated in FIG. 2.

FIG. 5 represents another embodiment of the AC electromagnet illustrated in FIG. 2. The AC electromagnet as illustrated in FIG. 5 comprises an elongated comb-like core 36 having an elongated plate-like body and a plurality of equi-spaced projections extending from one longitudinal edge thereof, and an AC coil 27 which is wound substantially horizontally around an outer periphery of the plate-like body of the core 36.

In relation to the amplitude of vibration of the molten metal, it has been found that the smaller the pitch (p) of the AC magnetic field, the greater the amplitude becomes. Thus the smaller the pitch between adjacent projections, the more effective the core becomes in providing greater amplitude. However too small a pitch between projections would lead to a uniform magnetic field. It has been found that a projection pitch of 5 mm produces an effective vibration of the molten metal of the pool.

Figure 6:
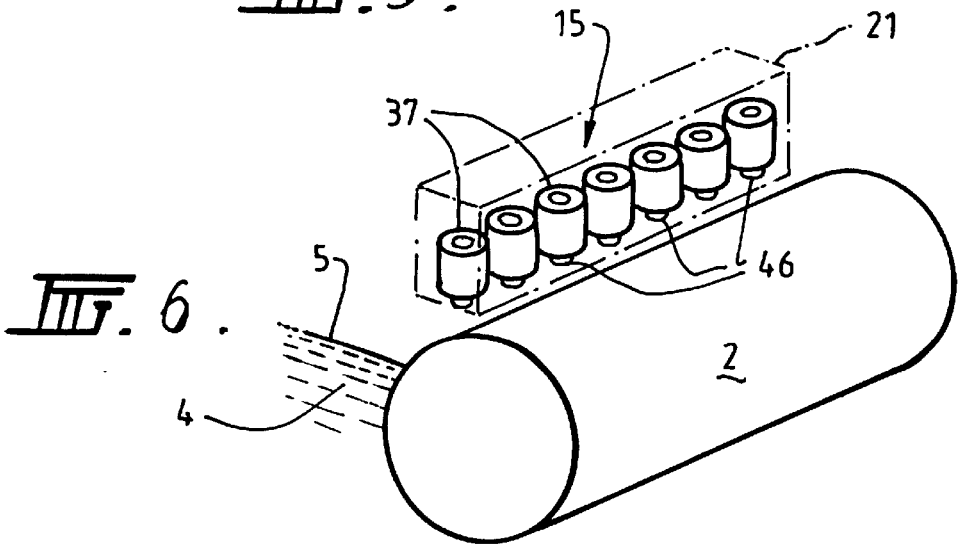
FIG. 6 A perspective view of another embodiment of the present invention.

FIG. 6 represents another embodiment of the present invention in which the AC electromagnet 15, which is arranged substantially directly above the meniscus 14 so that magnetic fluxes run substantially perpendicular to the surface of the molten metal 5, comprises a plurality of AC coils 37 each of which is wound cylindrically around a rod-like core 46. Also in this case, an AC magnetic field similar to that in the above embodiment can be formed so that induction current (eddy current) running axially of the rolls 1 and 2 can be generated to give high frequency vibration to the molten metal 5 in the melt pool 4.

It is needless to say that the method and the apparatus for giving vibration to molten metal in a twin roll continuous casting machine according to the present invention are not limited to the above embodiments and that various changes and modifications may be made without departing from the spirit and the scope of the invention. For example, the means to provide the AC electromagnetic field may be in the form of one AC electromagnet extending the length of the casting pool.

According to the method and the apparatus for giving vibration to molten metal in a twin roll continuous casting machine of the present invention, various superb effects as given below can be attained.

(I) Since electromagnetic forces are utilised to give high frequency vibration on non-contact basis to the molten metal in the melt pool, solidification efficiency of the molten metal, in particular, initial solidification efficiency near the meniscus can be remarkably enhanced, which enables increase of rotating velocity of the rolls to drastically improve productivity.

(II) Enhancement of solidification efficiency of the molten metal enhances separability of the solidified shell from the roll surfaces, which contributes to improved surface property of the produced strip.

(III) In the apparatus for giving vibration to molten metal in a twin roll continuous casting machine of the present invention, when the AC and DC electromagnets are held by the water-cooled jackets, the electromagnets can be protected from heat of the molten metal, which contributes to drastic enhancement of durability of the electromagnets.

We claim:

1. A method of continuously casting metal strip comprising:

introducing molten metal into a nip between a pair of parallel casting rolls via metal delivery means disposed above the nip to create a casting pool of molten metal supported on casting surfaces of the rolls immediately above the nip;

counter-rotating the casting rolls to deliver a solidified metal strip downwardly from the nip; and applying simultaneously a DC magnetic field and an AC magnetic field to edge margins of the molten metal of the casting pool extending along a meniscus defined by the molten metal of the pool and the casting surfaces of the rolls to induce high frequency relative vibratory movement between the molten metal of the casting pool and the casting surfaces of the rolls along the meniscus.

2. A method according to claim 1 wherein the AC magnetic field is applied along an edge margin of the pool extending along a meniscus defined by the molten metal of the casting pool and the casting surface of the rolls by means of a pair of AC electromagnets, each AC electromagnet being disposed above the meniscus of each respective roll and extending substantially parallel thereto and wherein the DC magnetic field is applied by means of a pair of DC electromagnets arranged over the length of the AC electromagnets.

3. Apparatus for continuously casting metal strip comprising a pair of parallel casting rolls forming a nip between them, metal delivery means for delivery of molten metal into the nip between the casting rolls to form a casting pool of molten metal supported by casting roll surfaces immediately above the nip, roll drive to drive the casting rolls in counter-rotational direction to produce a solidified strip of metal delivered downwardly from the nip, and vibration means operable to induce high frequency relative vibratory movement at and along a meniscus defined by the molten metal of the casting pool and the casting surfaces of the rolls, wherein the vibration means comprises means to provide an AC electromagnet field and means to provide a DC electromagnet field, said AC electromagnet means being arranged substantially directly above the edge margin of the molten metal of the casting pool and extending along the length of the meniscus of the casting pool such that magnetic fluxes run substantially perpendicular to the surface of the molten metal, and said DC electromagnet means is arranged over the length of said AC electromagnet means such that magnetic fluxes run substantially perpendicular to the surface of the molten metal.

4. Apparatus as claimed in claim 3 wherein the AC electromagnet means comprises a pair of substantially parallel spaced apart AC electromagnets with each AC electromagnet being arranged substantially above the respective meniscus defined by the molten metal of the casting pool and the casting surface of each roll over the length of each meniscus.

5. Apparatus as claimed in claim 4 wherein the DC electromagnet means comprises a pair of substantially parallel spaced apart DC electromagnets with each DC electromagnet being arranged substantially above and extending the length of its respective AC electromagnet.

6. Apparatus as claimed in claim 5 wherein the AC and DC electromagnets are held by water cooled jackets, respectively.

7. Apparatus as claimed in any one of claims 4 to 6 wherein each AC electromagnet comprises an elongated comb-like core having an elongated plate-like body and a plurality of equispaced projections extending from a longitudinal edge thereof, and an AC coil wound around the outer periphery of the core.

8. Apparatus as claimed in any of claims 4 to 6 wherein each AC electromagnet comprises a plurality of rod-like cores, each core having an AC coil wound cylindrically therearound.

9. A method of giving vibration to an edge margin of molten metal along as meniscus defined by the molten metal of the casting pool and each of the rolls in a twin roll continuous casting machine comprising the steps of applying simultaneously a DC magnetic field and an AC magnetic filed at and along the meniscus thereby generating induction current in the molten metal, and giving high frequency vibration to said molten metal edge margin by Lorentz's force due to interaction of said induction current with said DC magnetic field.

10. Apparatus for giving vibration to an edge margin of molten metal in a casting pool of a continuous casting machine having at least one casting roll, comprising an AC electromagnet arranged substantially directly above a meniscus defined by the molten metal in a casting pool and a casting surface of said at least one roll over the length of the meniscus such that magnetic fluxes run substantially perpendicular to a surface of said molten metal and a DC electromagnet arranged over the length of said AC electromagnet such that magnetic fluxes run substantially perpendicular to the surface of the molten metal thereby to induce high frequency relative vibratory movement between the molten metal of the casting pool and the casting surface of said at least one roll along the meniscus.

11. Apparatus as claimed in claim 10 wherein the AC and DC electromagnets are held by water-cooled jackets, respectively.

12. Apparatus as claimed in claim 10 or 11 wherein the AC electromagnet comprises an elongated comb-like core having an elongated plate-like body and a plurality of equispaced projections extending from a longitudinal edge thereof, and an AC coil wound around the outer periphery of the core.

13. Apparatus as claimed in claim 10 or 11 wherein the AC electromagnet comprises a plurality of rod-like cores, each core having an AC coil would cylindrically therearound.

* * * * *